United States Patent [19]

Chung

[11] Patent Number: 4,681,532

[45] Date of Patent: Jul. 21, 1987

[54] BOILER FURNACE AIR REGISTER

[76] Inventor: Landy Chung, 5144 Cliff Dr., Ashtabula, Ohio 44004

[21] Appl. No.: 729,690

[22] Filed: May 2, 1985

[51] Int. Cl.[4] ..... F23M 9/00

[52] U.S. Cl. ..... 431/183; 110/264; 239/405; 239/416.5; 431/188

[58] Field of Search ..... 431/182, 183, 185, 188; 110/264, 347; 239/405, 416.5

[56] References Cited

U.S. PATENT DOCUMENTS 3,014,523 12/1961 Huge ..... 431/184 X
4,479,775 10/1984 Wiesel ..... 431/182
4,500,282 2/1985 Eschenko et al. ..... 431/184
4,504,216 3/1985 Hagar et al. ..... 431/182 A
4,530,657 7/1985 Brashears et al. ..... 431/188

*Primary Examiner*—Edward G. Favors
*Attorney, Agent, or Firm*—James H. Tilberry

[57] ABSTRACT

An air register is provided for admitting to and regulating combustion air in industrial open flame heated boilers and furnaces. The register comprises an outer member to impart rotation, balancing and blending of opposed incoming air streams; an inner member to impart a spiral motion to a resultant single air stream in the direction of the boiler or furnace entrance; and a third member to form the air stream into a flame encompassing envelope.

39 Claims, 19 Drawing Figures

BOILER FURNACE AIR REGISTER

BACKGROUND OF THE INVENTION

The present invention relates in general to air registers for furnaces and boilers and, in particular, to air registers designed to admit and to regulate air necessary to support combustion in industrial furnaces and boilers. Specifically, the invention relates to air registers used with coal, oil or gas fired steam generating boilers.

Air registers per se, are well known by those skilled in the art and air registers designed to regulate more than one source of combustion air are also well known. Thus, the prior art is replete with disclosures of air registers referring to so-called primary, secondary and even tertiary combustion air and various means to deliver this air to a boiler. Although each inventor of air registers defines and refers to combustion air in accordance with his own background and concepts, combustion air usually falls into two broad categories. Primary air is generally understood to refer to air which is used as a carrier medium to transport the fuel to the furnace. Powdered coal is a good example of a fuel which is transported in a stream of air through a separate fuel pipe. Since transport air only supplies about 18% of the air needed for full combustion, an additional supply of air must be brought into the boiler from another source and by another means. This "make up" air is sometimes called "secondary air", and is supplied in sufficient volume to provide the additional 82% of required air. However, if a boiler is oil or gas fired, usually little or no supplemental means are required to transport these fuels since thay are generally self-transporting. Thus, substantially 100% of the combustion air must be supplied from some source. Whether air from this source is labeled primary or secondary is a matter of semantics. It is obvious that the source of air supplied through a given register in a powdered coal burning boiler might be referred to as "secondary". On the other hand, a source of air supplied through the same register for use in the same boiler while being operated on oil might be referred to as primary air. In the alternative, the source of air through the air register may be called secondary irrespective of whether the boiler is being coal fired, oil fired or gas fired. One fact is indisputable, the function of the air remains the same irrespective of its label.

For many years a so-called "daisy chain" type damper air register was widely used in the energy generating industry. Examples of this type of register are shown in U.S. Pat. Nos. 2,320,576 and 2,838,103. The dampers for this type of register were positioned immediately adjacent to the throat of the boiler and the complex damper operating mechanism known as a daisy chain has a history of high incidence of failure due to overheating. After a short period of operation the daisy chain linkage would freeze, rendering the dampers inoperable. Thus, operators were afraid to close the dampers during the firing of a boiler because of the high probability that they would freeze in the closed position, thereby rendering the air register inoperable. As a consequence, the daisy chain dampers were usually left wide open at all times, which rendered the register useless as a means of obtaining and controlling efficient fuel combustion.

Recently, a new register has come on the market which is essentially a scroll with a single air entrance remote from the boiler throat and with but one butterfly damper in the air entrance. From a reliability standpoint, this damper would appear to be an improvement over the daisy chain operated type of damper.

Flame shape control is important in boiler operation since the shape of the flame will determine the efficiency of the boiler combustion. In addition to reduced cost of boiler operation, an efficiently operated boiler also reduces the amount of stack flyash; the amount of unburned coal which, when carried to the uppermost reaches of the boiler, cokes and generates a dangerous gas by-product. Nitrous oxide is also a by-product of combustion. Free nitrous oxide escapes up the stack and contributes to air pollution. As presently advised, the U.S. Environmental Protection Agency (EPA) regulations for new boilers restrict the amount of nitrous oxide permitted to escape up the stack to 0.7 pounds per million BTU. Although the EPA has not yet set nitrous oxide emission limitations for old boilers, as will be developed, the present invention enables even old less efficient boilers to operate under the limits of nitrous oxide emission required by the EPA for new boilers.

Since efficiency of combustion is a function of flame shape, if a flame is restricted to a narrow pencil-like shape it is relatively inefficient. As the flame is permitted to open tranversely, its efficiency increases because more room is available within the flame to mix fuel and air. Heretofore, prior art air registers have been the generally accepted means for delivering combustion air to boilers. However, because they do not deliver air efficently, the energy required to deliver air to the boiler results in excessive energy costs. More importantly, prior art registers have not provided the means for controlling the boiler flame in such a manner as to obtain combustion efficiency.

SUMMARY OF THE INVENTION

This invention has been developed for the purpose of solving endemic problems of prior art air registers, as previously discussed. Reduced to fundamentals, the invention comprises method and apparatus to transport boiler combustion air and to subject the air sequentially to three aerodynamic modes prior to combustion. Air under pressure, such as induced in a wind box, is forced into opposite sides of an outer member or shroud. This shroud is configured to induce the incoming air to enter the first mode, i.e., to form an air couple. An inner member of biased aerodynamic vanes intercepts air from the air couple and induces it into the second mode, i.e., a spiral movement of air with an axial thrust toward the boiler throat; a third member comprising a throw ring having radially inwardly directed blades secured to the inner periphery of the ring, directs the combustion air into the third and final mode, i.e., an envelope of air about the burner flame. This method and apparatus for transporting and translating combustion air through these three described modes results in lower energy costs to move combustion air from a source, such as wind box, to a combustion zone, such as a boiler. This method and apparatus also obtains a better volumetric balance of combustion air which enables more uniform and steady combustion. This method and apparatus also provides flame shape control, irrespective of combustion air volume or rate of flow. In addition, this method and apparatus provides an envelope of high pressure combustion air about a low pressure flame. Under these conditions, the flame tends to turn back upon itself towards its low pressure center. In so doing, it stabilizes and resists extinguishment. Finally, this method and apparatus maintains combustion remote from the throw ring thereby increasing the life of the air register and minimizing the chance of flashback. Flashback is defined as the undesirable phenomenon in which the flame fuel burning rate exceeds the rate of flow of the fuel being fed to the flame, thereby enabling flame retrogression into the fuel conveyor pipe. Flashback may culminate in an uncontrolled and destructive explosion within the fuel conveyor pipe.

OBJECTS OF THE INVENTION

It is therefore among the objects of the invention to provide an air register which: delivers combustion air to a boiler with reduced energy consumption; delivers combustion air to a boiler to coact with the furnace flame to improve combustion efficiency; is comprised of but two maintenance free-moving parts; is inexpensive to manufacture and to install; is easily dismounted and disassembled; is easily repaired; may be synchronized with like air registers for remote control; is conprised of three principal parts, an outer member, an inner member and a throw ring; controls the shape of the furnace flame; will reduce nitrous oxide emission to below EPA standards for old boilers as well as new boilers; will deliver combustion air to a boiler in such manner as to delay combustion immediately in front of the boiler throat, thereby protecting the register from overheating; will deliver combustion air in an envelope about the flame to create high pressure in the envelope and low pressure in the flame, thereby stabilizing the flame; will deliver combustion air to the furnace in an envelope about the flame to minimize flame flash-back into the fuel conveyor pipe; will deliver combustion air in an envelope about the flame in a concentration and velocity which will reduce the probability of blowing out an unstable flame, thereby reducing the possibility of explosion of unburned powdered coal in the upper reaches of the boiler; has an outer member adapted to admit air from opposite sides to form an air couple, balance and mix the incoming air and to direct said air toward the inner member in an even controlled volume and compression; has an inner member adapted to receive the air from the outer member with a minimum of pressure drop; has an inner member adapted to convert the air couple in the outer member into spiral movement within the inner member having an axial thrust toward the throat of the boiler; has an inner member comprised of air foil type blades arrayed in a frustoconical configuration and adapted to provide smooth energy efficient transition of air from the outer member to the inner member; includes a throw ring adapted to maintain flame shape irrespective of the position of register dampers; and includes a throw ring having deflector blades adapted to cause combustion air to envelope the primary air and flame to stabilize the flame and increase efficiency of combustion.

It is also among the objects of this invention to provide a method of transporting combustion air from a source to a combustion zone with a minimum expenditure of energy; to mix the combustion air with fuel and flame to achieve more efficient combustion; and to control the combustion to prevent flash-back into the fuel pipe and to protect the air register from overheating.

The foregoing and other objects, features and advantages of the invention will become apparent from the description set forth hereinafter when considered in conjunction with the accompanying drawings.

DETAILED DESCRIPTION OF THE PREFERRED EMBODIMENT OF THE INVENTION

General Discussion

Figure 1:
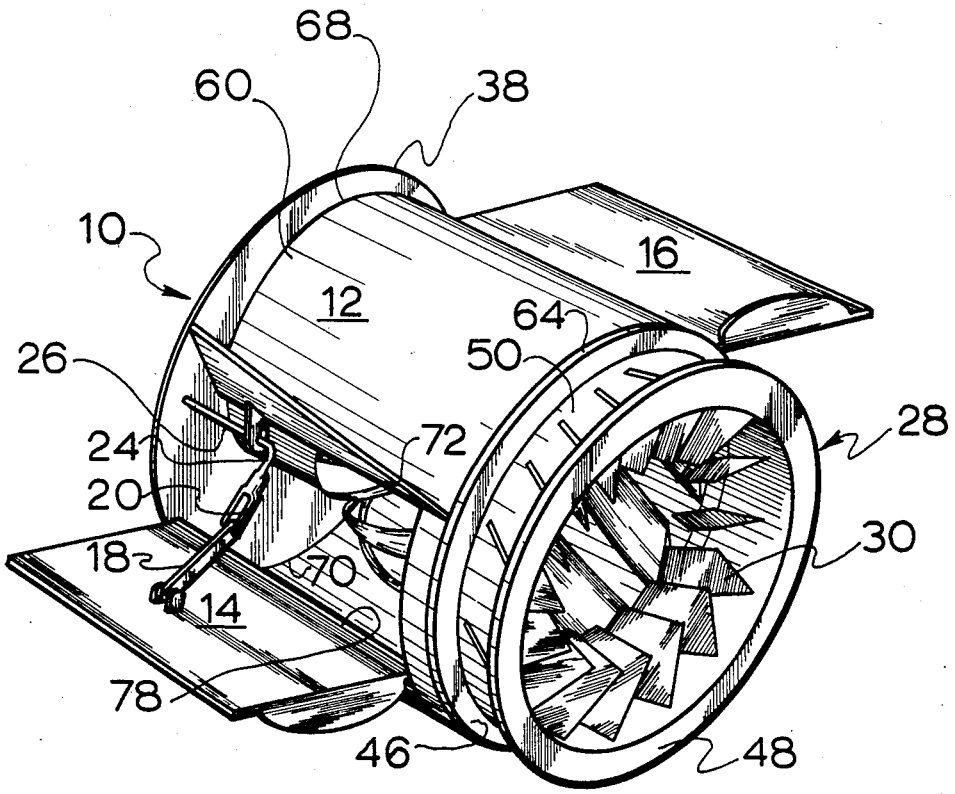
FIG. 1 is a modified perspective view of a preferred embodiment of the invention, viewed from the front, upper left hand side.

Reference is now made to the drawings and in particular to FIG. 1. Therein is shown an air register 10, comprising an outer member, or shroud 12, having hinged air dampers 14 and 16 on opposite sides of the shroud. The dampers are actuated by toggle links 18 and clevises 20 threadedly fastened to arms 24 of damper control rods 26. Control rods 26 may be manually rotated to open, adjust or close dampers 14 and 16. Control rods 26 may also be remotely actuated by motor drive means, whereby dampers 14 and 16 are adjusted in unison. A throw ring 28 is secured to the front end of shroud 12 and is provided with radially inwardly projecting blades 30.

Figure 2:
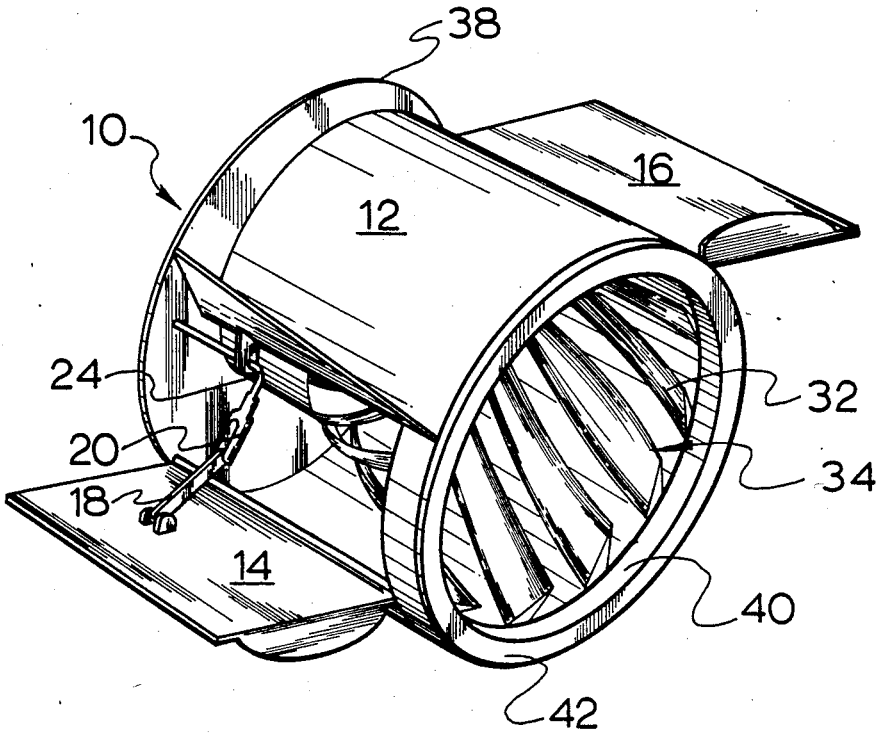
FIG. 2 is a modified perspective view of the invention shown in FIG. 1 with the front throw ring removed for better viewing of the interior of the invention.
Figure 3:
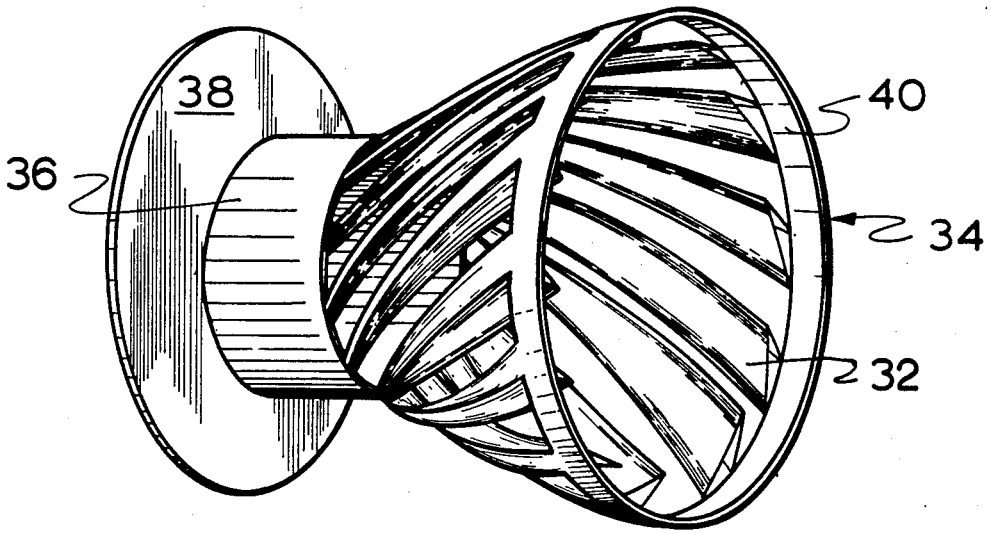
FIG. 3 is a modified perspective view of the frustoconical array of air guiding vanes partially shown in FIG. 2, and viewed from the front lower left hand side.
Figure 4:
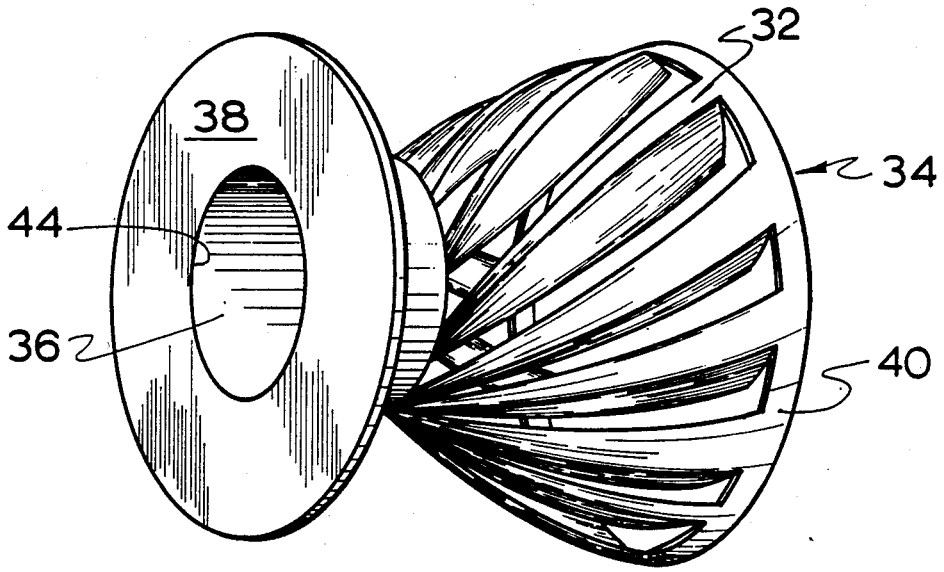
FIG. 4 is a modified perspective view of the air guiding vanes shown in FIG. 3, viewed from the rear, lower right hand side.

The throw ring 28 of FIG. 1 has been removed from the shroud 12 of FIG. 2 to better show the aerodynamic vanes 32 of frustoconical inner member 34. Frustoconical inner member 34 is shown in FIGS. 3 and 4 to comprise a back plate sleeve 36 secured to back plate 38 of shroud 12, a frustoconical band 40 and a plurality of aerodynamic vanes 32 integrally interconnecting sleeve 36 to band 40. Band 40 is, in turn, secured to shroud mounting flange 42, FIG. 2, such as by welding. It is to be noted that sleeve 36 is concentrically positioned with hole 44 of shroud back plate 38 and welded to back plate 38 in this concentric position.

Figure 5:
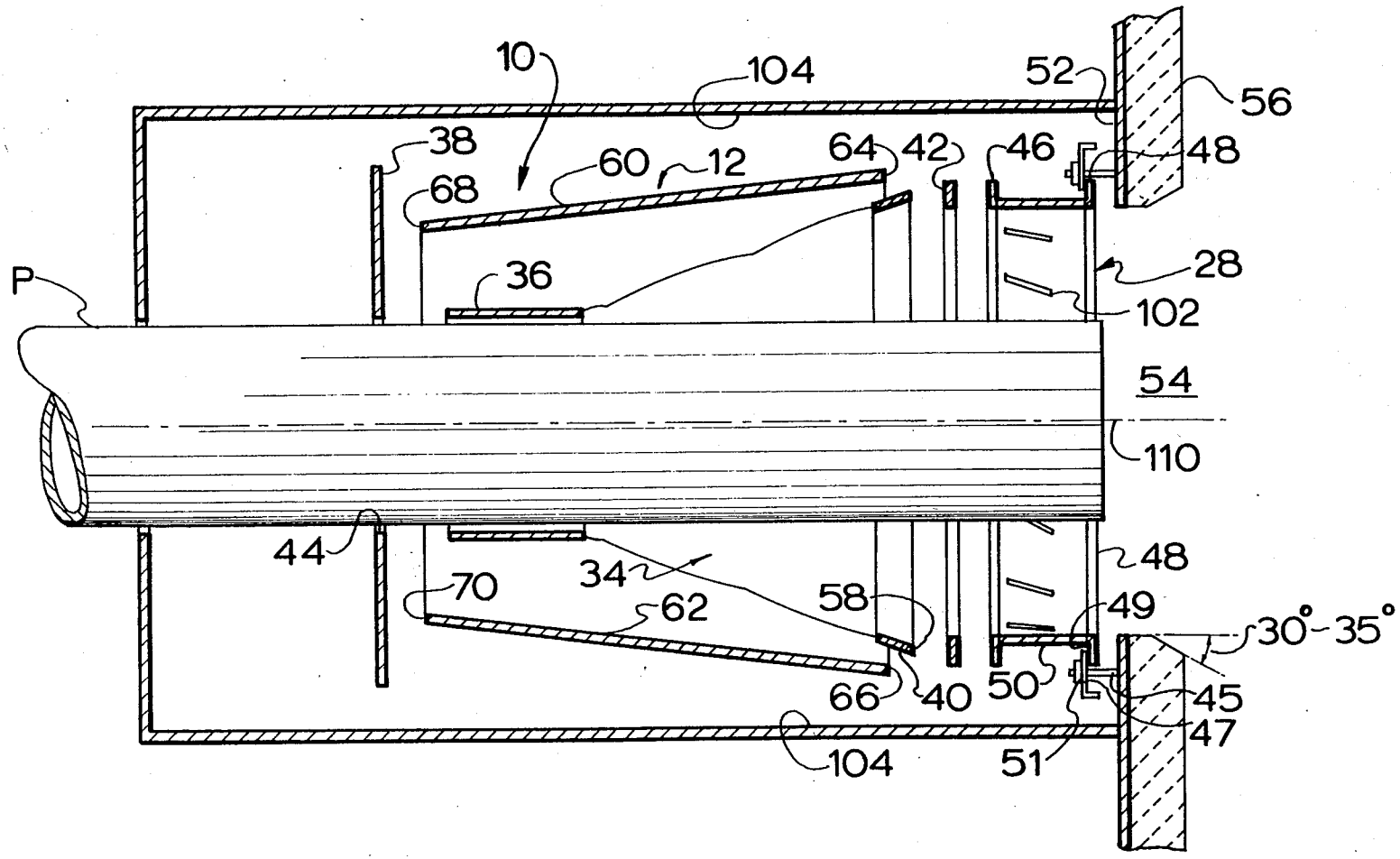
FIG. 5 is an exploded view, partially in section, of the embodiment of the invention shown in FIG. 1.

Reference is now made to FIG. 5, which is an exploded view, partially in section, of the air register 10 shown in FIG. 1. Hole 44 is sized to admit a fuel conveyor pipe P to pass therethrough. Conveyor pipe P is also concentrically positioned to pass through sleeve 36; the inner member 34, shroud mounting flange 42 and throw ring 28, comprising throw ring mounting flange 46, boiler wall mounting flange 48, and blade mounting ring 50. Flange 48 is securable to boiler wall plate 52 which surrounds the boiler throat 54 in boiler wall 56. Threaded studs 45 are welded to boiler wall plate 52 about throat 54. A clamping ring 47 engages the inner face 49 of mounting flange 48. Threaded nuts 51, on studs 45, draw clamping ring 47 and mounting flange 48 into pressure contact with boiler wall plate 52. In a preferred assembly, sleeve 36 is welded to back plate 38 concentric with hole 44. The outer rim 58 of frustoconical band 40 is welded to shroud flange 42 and shroud flange 42 is welded to front edges 64 and 66 of side plates 60 and 62 of shroud 12. Throw ring 28 is mounted on shroud 12 by passing threaded fasteners through flanges 42 and 46.

The Outer Member

Figure 6:
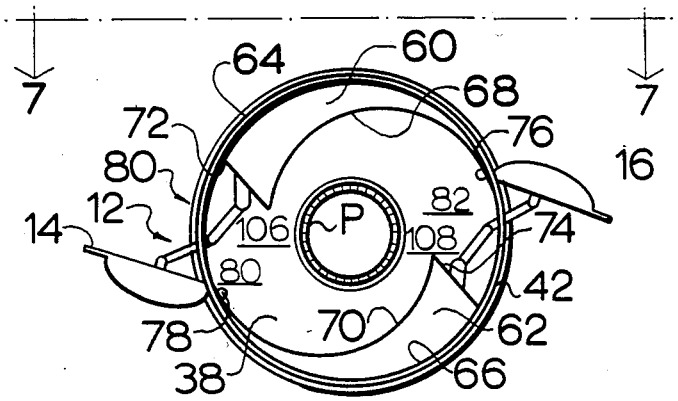
FIG. 6 is a front elevational view of the outer shroud member of a preferred embodiment of the invention taken along the line 6—6 of FIG. 7.
Figure 7:
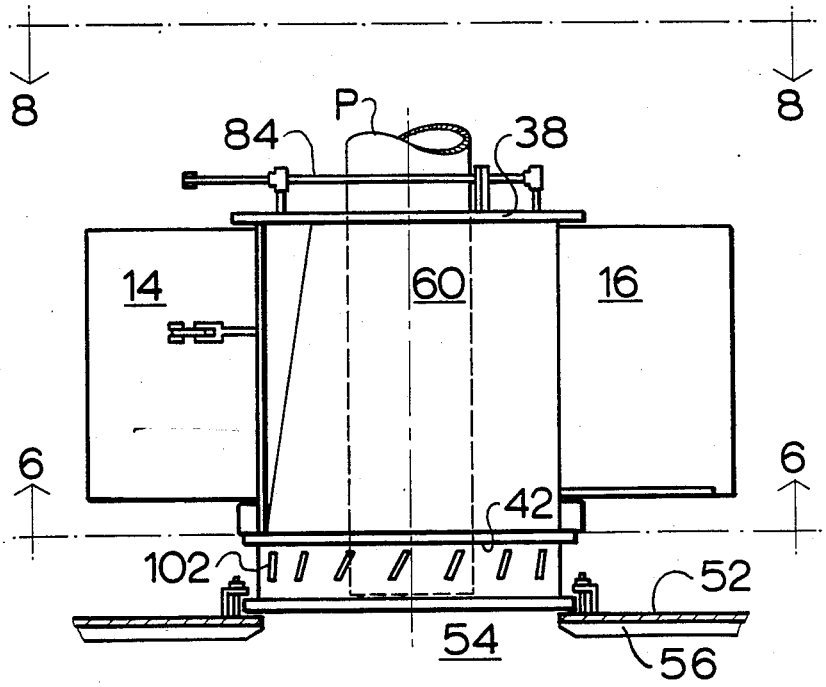
FIG. 7 is a plan view of the air register shown secured to the throat of a boiler wall taken along the line 7—7 of FIG. 6.
Figure 8:
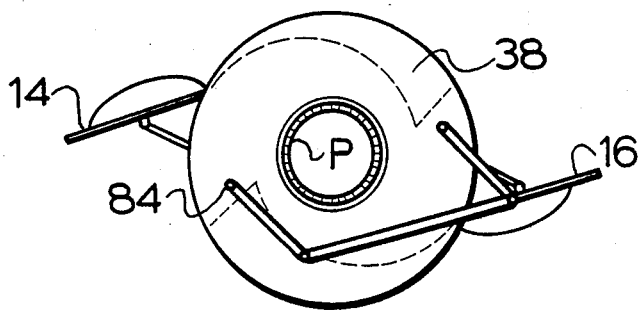
FIG. 8 is a rear elevational view of the outer shroud member taken along the line 8—8 of FIG. 7.

Shroud 12 is illustrated in FIGS. 5, 6, 7 and 8, and comprises back plate 38, front mounting flange 42 and intermediate shroud side plates 60 and 62. Side plates 60 and 62 are dimensionally identical, but of opposite hand. Thus, front edges 64 and 66 comprise arcs of circles of the same radius as the radius of front flange 42 to which they are secured and concentric thereto. Back edges 68 and 70 comprise arcs of circles of smaller radius than the radius of front flange 42, and are positioned eccentric thereto, as best shown in FIG. 6, causing side edges 72 and 74 to incline inwardly from front flange 42 to back plate 38. Side edges 76 and 78, on the other hand, are normal to back plate 38 and front mounting flange 42. As so defined, side plates 60 and 62 are approximately frustoconical sections, with the generatrix line of each being substantially parallel to the frustoconical inner member 34 and with the transverse distances between side plates 60 and 62 gradually decreasing as the side plates 60 and 62 converge inwardly toward inner member 34. Edges 72 and 78 define an opening 80 which is selectively opened, closed or partially opened by damper 14. Edges 74 and 76 define opening 82 which, in like manner, is adjusted by damper 16. Dampers 14 and 16 are shifted in unison by toggle and link drive means 84 and may be remotely controlled.

The Inner Member

Figure 9:
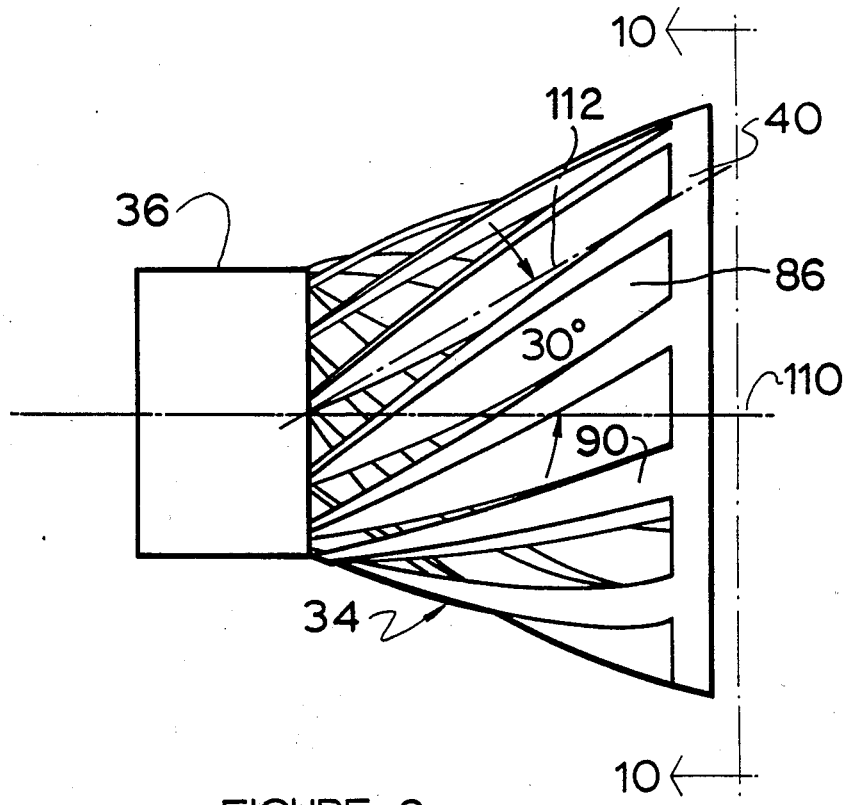
FIG. 9 is a side elevational view of the inner frustoconical member shown in FIG. 3.
Figure 10:
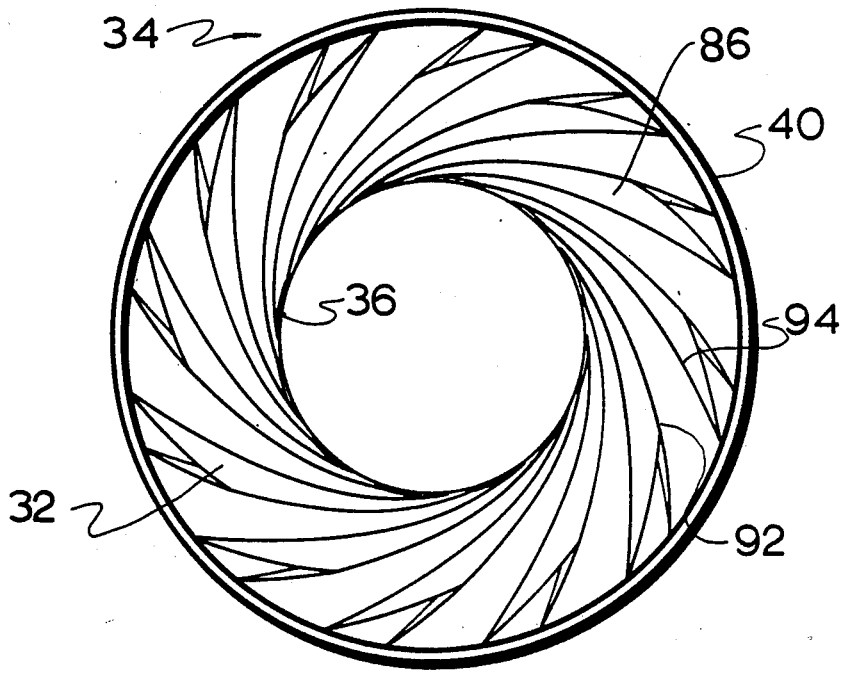
FIG. 10 is a front elevational view of the inner frustoconical member taken along the line 10—10 of FIG. 9.
Figure 11:
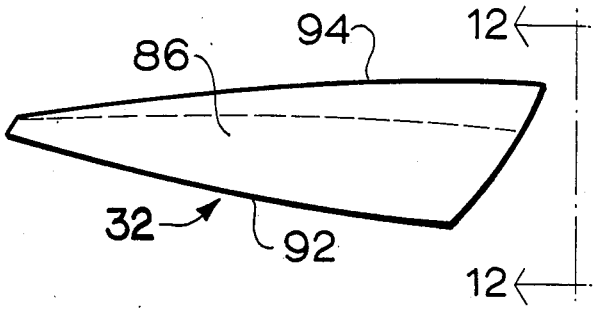
FIG. 11 is a front elevational view of a typical vane of the inner frustoconical member of FIG. 10.
Figure 12:
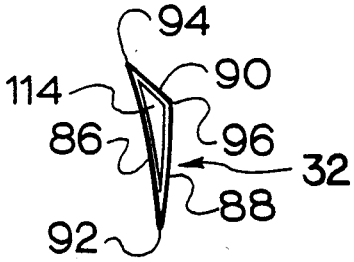
FIG. 12 is an end view of the vane shown in FIG. 11 taken along the line 12—12 of FIG. 11.
Figure 13:
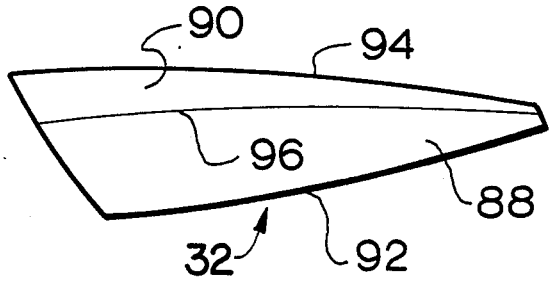
FIG. 13 is a rear elevational view of the typical vane shown in FIG. 11.
Figure 14:
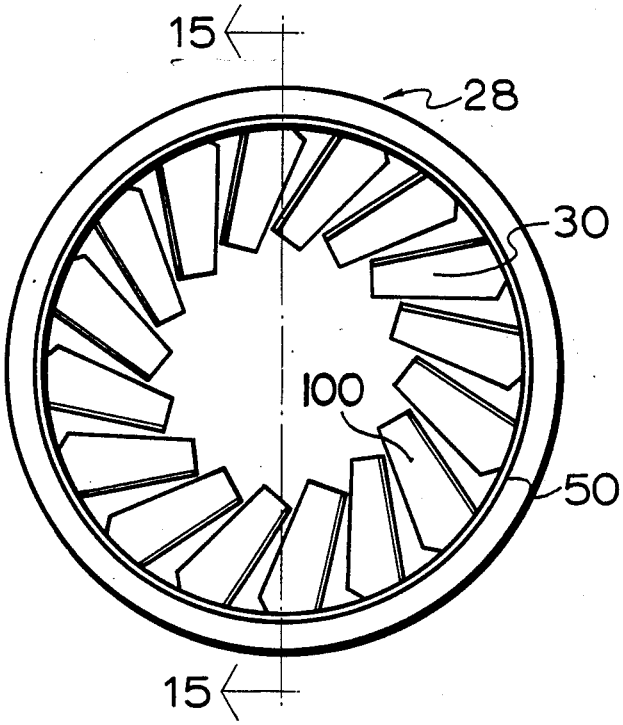
FIG. 14 is a front elevational view of the throw ring shown in FIG. 1.

FIGS. 9, 10, 11, 12 and 13 illustrate the aerodynamic vanes 32 of inner member 34, which are welded at their narrow ends to sleeve 36 and to band 40 at their wider ends. As best shown in FIG. 10, vanes 32 extend between sleeve 36 and band 40 in an expanding frustoconical spiral array. As shown in FIGS. 11, 12 and 13, each vane is hollow and is fabricated from a primary concavely curved vane member 86, a secondary convexly curved vane member 88 and a convexly curved structural support member 90. The vanes 32 may be welded between sleeve 36 and band 40 on either a right or left hand bias and are positioned so that the leading edge 92 of each vane slightly overlaps the trailing edge 94 of the preceding vane. Structural support members 90 are welded at opposite ends to sleeve 36 and band 40 and define the surface of the frusto-conical inner member 34. Primary vane member 86 is joined along trailing edge 94 to structural member 90 and depends inwardly therefrom. Secondary vane member 88 is joined to structural member 90 along edge 96 of structural member 90 and also depends inwardly therefrom to join primary vane 86 along leading edge 92.

The Throw Ring

Figure 15:
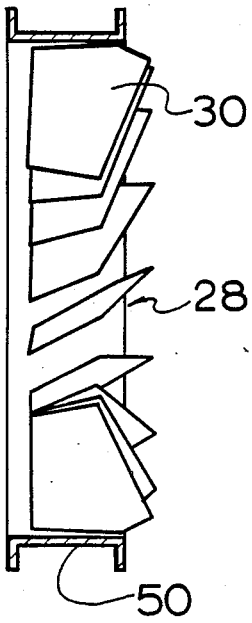
FIG. 15 is a sectional view taken along the line 15—15 of FIG. 14.
Figure 16:
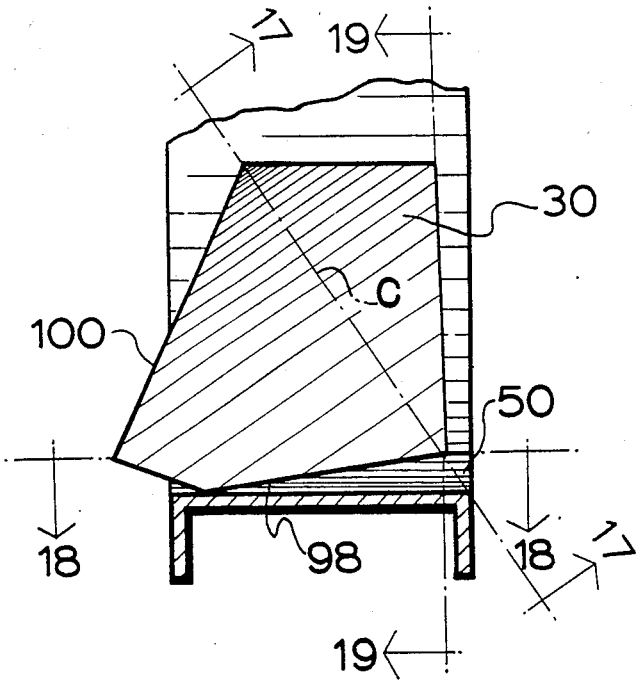
FIG. 16 is an elevational profile view of one of the plurality of blades mounted within the throw ring shown in FIG. 14.
Figure 17:
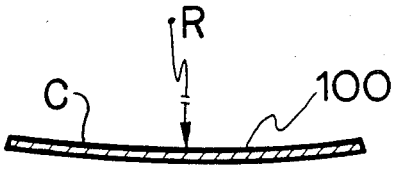
FIG. 17 is a sectional view taken along the line 17—17 of FIG. 16.
Figure 18:
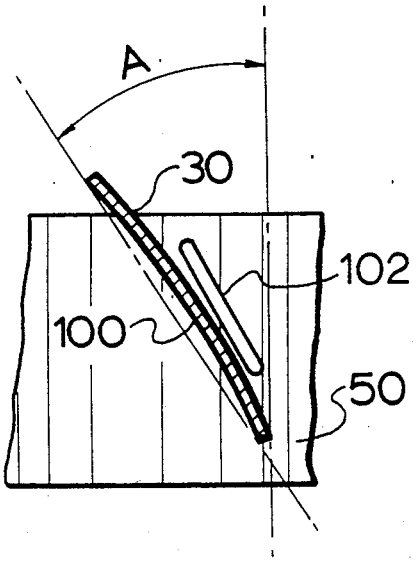
FIG. 18 is a fragmentary sectional view taken along the line 18—18 of FIG. 16.
Figure 19:
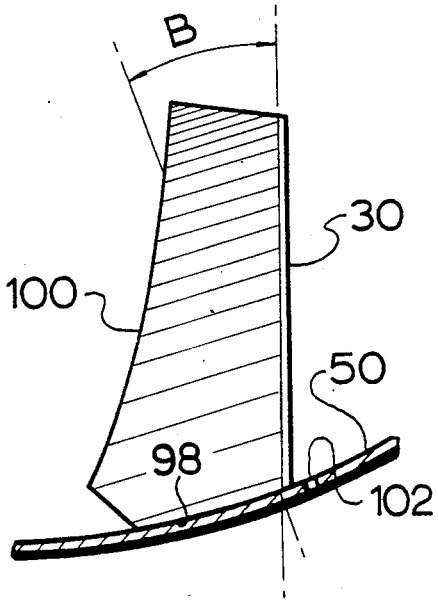
FIG. 19 is a fragmentary sectional view taken along the line 19—19 of FIG. 16.

Throw ring 28 has mounted on the inner surface of ring 50 a plurality of blades 30, as shown in FIGS. 14, 15, 16, 17, 18 and 19. The surface 100 of blade 30 is cylindrically curved with the curvature C falling along line 17—17, as shown in FIG. 16. The radius R of curvature C is approximately one-half of the radius of the air register 10. Blade bottom edge 98 is curved to conform to the curvature of ring 50 when secured to ring 50 at angle A as shown in FIG. 18. Blade 30 is also inclined angle B to ring 50 as shown in FIG. 19. In the preferred embodiment of the invention it has been found that for throw rings having diameters in the range of approximately 40" to 60", blades 30 provide the least pressure drop when angle A, FIG. 18, is between 25° and 30°$\neq$2° and angle B, FIG. 19, is between 7° and 12°$\neq$2°. The concave curved surface 100 of blade 30 is the high pressure side of the blade. The blades are prevented from over heating by air cooling slots 102 formed in ring 50, FIGS. 5 and 19.

OPERATION OF THE AIR REGISTER

In operation a source of pressurized air is required, such as from a wind box 104 mounted on the furnace wall plate 52. See FIG. 5. A wind box is a common expedient well known to those skilled in the art for supplying combustion air to air registers. One or more air registers are mounted on furnace wall 52 and are enclosed by a simple rectangular wind box 104. Air is pumped into the wind box at a rate sufficient to maintain a desired pressure in the wind box. Referring to FIG. 6, air from the wind box 104 is forced into air register entrances 80 and 82 forming two streams, the first stream being guided by arcuately curved side member 60 and the second stream being guided by arcuately curved side member 62. The streams move counterclockwise to form an air couple with mixing and balancing of the streams in zones 106 and 108. As the two streams rotate in shroud 12, arcuately curved side walls 60 and 62 urge and compress the streams into paths parallel to frustoconical inner member 34. It will be readily understood that by reversing the configuration of side plates 60 and 62 the air couple will be caused to rotate clockwise instead of counterclockwise. The air couple rotation is a matter of choice to be made by the boiler designer or operator, depending on the location of the air register on the boiler wall and other considerations well known to those skilled in the art.

When the air streams reach the surface of inner member 34 they are received between vanes 32 which change the direction of the air streams from rotation normal to the longitudinal axis 110, FIG. 5, to a spiral rotation along the longitudinal axis 110 with a thrust in the direction of the boiler throat 52. Because of the configuration of vanes 32, air stream change of direction and confluence occurs smoothly and with a minimum of pressure drop. Smooth air stream transition is obtained because each vane 32 is provided with the concavely curved high pressure face 88 and the longitudinal axis 112, FIG. 9, of each vane is aligned approximately along a 30° bias from inner member longitudinal axis 110. Low pressure face 88 also reduces back side turbulence and consequent pressure drop by closing the triangle formed by vane members 86, 88 and 90 to define an enclosed hollow cavity 114. See FIG. 12. With cavity 114 so enclosed turbulence is prevented from occuring in the air pocket formed between members 86 and 90. The bias of vanes 32 and blades 30 may be either right or left hand depending on the particular needs of the boiler at the location where the air register is mounted. It will be understood that the rotation of the air couple must be coordinated with the bias of the air vanes 32 and throw ring blades 30. Thus, as shown in the drawings, with the counter-clockwise rotation of air induced by side plates 60 and 62, the inner member air vanes 32 are biased to the left as shown in FIGS. 3, 9 and 10, and blades 30 are also biased to the left as shown in FIGS. 15 and 18. For clockwise movement of air, vanes 32 and blades 30 would be correspondingly biased to the right.

In dampered prior art registers the shape of the flame is a function of the position of the dampers. Thus, when the dampers are fully open, the flame is fully expanded, which is desirable for complete and efficient combustion. However, in order to reduce the BTU capacity of a furnace responsive to reduced demand, it is necessary to proportionately close the dampers. Unfortunately, when this is done, the flame shape also changes proportionately and this is undesirable for efficient furnace operation. When the flame is fully expanded, there is more flame volume within which to mix fuel and air for complete combustion. As the dampers close the flame is narrowed to a pencil-like shape. With this flame shape, combustion begins too close to the boiler throat, thereby not permitting sufficient time for complete mixing of air and fuel prior to burning. Also the narrow shape of the flame itself retards thorough mixing of air and fuel. As a result, excessive nitrous-oxide is formed which is an air pollutant. As already stated, the U.S. Environmental Protection Agency (EPA) limits nitrous-oxide formation to 0.7 pounds per million BTU generated. As a consequence, in order to comply with EPA regulations it is necessary to leave prior art dampers fully open during furnace operation or risk violation of EPA regulations.

The throw ring 28 is essential for a completely successful operation of the subject air register since it enables the optimum expanded shape of the flame to be maintained irrespective of the position of the damper. The above described setting of the blades 30 within the ring 50 also causes the spiral air stream passing through the inner member 34 to fan out and concentrate more about ring 50. Upon leaving the ring 50, the air stream delays combustion so that excess heat does not build up immediately in front of the boiler throat. As a result, the life of the air register is extended, less nitrous-oxide is generated and the danger of flashback is minimized. With the subject throw ring old boilers can be operated with only 0.3 to 0.35 pounds of nitrous-oxide produced per million BTU generated. This represents a 50% reduction of nitrous-oxide pollutants even below EPA new boiler requirements. The air stream also extends to form a high pressure envelope about the flame to create a low pressure zone in the center of the flame. This causes the flame to roll back upon itself and to create a very stable flame. In the prior art registers if the velocity of the air is too concentrated along a narrow unstable flame, the flame will blow out. When a flame blows out, unburned powdered coal will concentrate in the upper reaches of the boiler. It then proceeds to coke and to produce an explosive gas. The present invention minimizes the danger of a gas explosion by the formation of a high pressure air envelope about a fully expanded flame.

For optimum performance of the air register, it has been determined that the ratios of the capacity of the dampered air inlets 80 and 82 to the capacity of the throw ring 28 and inner member 34 are very important. For example, the preferred embodiment of the invention functions most effectively when the combined areas of inlets 80 and 82 are substantially 1.2 times greater than the combined areas of the spaces between the concave vane members 86 and substantially 1.5 times greater than the area of the throw ring opening when the wind box pressure is within the range of substantially 0.2 psi to 1.2 psi above atmospheric pressure.

Having now described a preferred embodiment of the invention, it will occur to those skilled in the art, upon reading the specification in conjunction with a study of the drawings, that certain modifications may be made to the described air register. However, it is intended that the invention only be limited by the scope of the appended claims.

What is claimed is:

1. The method of delivering combustion air to an industrial heating flame comprising the steps of:

(1) directing a pair of streams of air toward each other to form a single rotating stream of air;

(2) compressing said streams of air within radially decreasing hollow frustoconical confines;

(3) imparting spiral rotation with an axial thrust to said single stream of air toward said flame; and (4) expanding said stream of air into a cylindrical envelope about said hearing flame.

2. The method of claim 1, including the steps of regulating the volume of each stream of air before confluence of said streams.

3. The method of claim 1, including the step of balancing each stream of air during rotation.

4. An air register to deliver combustion air to an industrial heating flame comprising:

an outer substantially frustoconical member;

an inner substantially frustoconical member nested within said outer member to define a radially decreasing frustoconical space adapted to compress streams of air therebetween, said members each having air stream ingress and egress means and being adapted to receive a fuel conveyor pipe concentrically therethrough; and a throw ring member mounted concentrically on the egress ends respectively of said outer and inner members;

said outer member having means to admit streams of air from opposite sides thereof to produce an air couple;

said inner member having means to convert said air couple into a spirally rotating air stream having an axial thrust toward its egress means; and said throw ring member having means to receive and to convert said spirally rotating air stream into a hollow high pressure stream of air adapted to envelope said heating flame.

5. An air register to deliver combustion air to an industrial heating flame comprising;

an outer member;

an inner member nested within said outer member and a throw ring member mounted concentrically on the egress ends respectively of said outer and inner members, said members each having air stream ingress and egress means and being adapted to receive a fuel conveyor pipe concentrically therethrough;

said outer member having means to admit streams of air from opposite sides thereof to produce an air couple;

said inner member having means to convert said air couple into a spirally rotating air stream having an axial thrust toward its egress means; and said throw ring member having means to receive and to convert said spirally rotating air stream into a hollow high pressure stream of air adapted to envelope said heating flame; said outer member comprising a pair of approximately frustoconical shaped side panel sections spaced apart to form a pair of air stream entrances, and means to damper said entrances.

6. The device of claim 5, wherein the end edges of said side panels proximate the egress end of said outer member are arcs of a common circle and the end edges of said side panels remote from said first mentioned edges are arcs of circles of like minor diameters, the centers of which are eccentric to the center of said circle of major diameter, whereby the approximate configuration of said outer member is that of a frustum.

7. The device of claim 5, wherein the said inner member comprises a plurality of air guiding vanes aligned on a bias to the longitudinal axis of said outer member, and arrayed in the configuration of a frustum and sized to nest concentrically within said outer member and to define an uninterrupted frustoconical air space therebetween.

8. The device of claim 7, wherein the said bias of said air vanes is substantially 30° to the longitudinal axis of said second member.

9. The device of claim 7, wherein each of said vanes comprises a concavely curved high pressure front face plate having a leading edge and a trailing edge, a convexly curved back face plate having a leading edge and a trailing edge, and an intermediate plate, said front and back face plates being joined along their respective leading edges and said intermediate plate being joined to the trailing edges of said front and back plates to form a triangular hollow vane wherein by changing the width of said intermediate plate, the air intake capacity of said inner member is changed.

10. The device of claim 9, wherein the leading edges of said vanes are inclined inwardly of said frustum to consecutively overlap the trailing edges of their respective proximate adjacent vanes as viewed from the interior of said inner member.

11. The device of claim 9, including a sleeve at the minor diameter end of said frustum and a ring at the major diameter end of said frustum and with the opposite ends of said intermediate plates being secured to said sleeve and to said ring respectively wherein the lengths of said vanes may be changed without changing the overall depth of said air register by changing the length of said sleeve.

12. The device of claim 5, wherein said throw ring member comprises a cylindrical ring and a plurality of blades secured about the inner periphery of said cylindrical ring to project radially inwardly therefrom; each of said blades being biased to the axis and inclined to the radius of said cylindrical ring.

13. The device of claim 12, wherein said bias is substantially between 25° and 30°, for cylindrical rings having diameters substantially between 40" and 60".

14. The device of claim 12, wherein said inclination is substantially between 7° and 12° for cylindrical rings having diameters substantially between 40" and 60".

15. The device of claim 12, wherein each blade comprises a top edge, a leading edge normal to said top edge, a trailing edge at an obtuse angle to said top edge and a bottom edge joining the lower ends of said leading and trailing edges and being convexly curved to fit the contour of the inner periphery of said cylindrical ring when said blade is set on a bias, and said blade being cylindrically curved along a circumference line defined by and extending between the intersection of said top and trailing edges and the intersection of said leading and bottom edges.

16. The device of claim 15, wherein said leading edge is set back from the leading edge of said cylindrical ring and said trailing edge overhangs the trailing edge of said cylindrical ring.

17. The device of claim 15, wherein said blade has a concave face and a convex face, and said concave face is the high pressure side of said blade.

18. The device of claim 12, including air cooling apertures in said cylindrical ring between each pair of blades and adapted to direct cooling air over the front and back faces of said blades.

19. An air register to deliver combustion air to an industrial heating flame comprising:

an outer frustoconical air intake shell processing member;

an inner frusto-conical louvered air processing member concentric within said outer member and spaced apart therefrom; and an outer air discharging and processing member;

said outer shell member having means to admit air from opposite sides of the shell to create an air couple between said outer shell and said inner member; means to compress said air about said inner member; and said inner member having means to process said air couple into a single spiral stream of air having an axial thrust toward said outer air processing member and said outer air processing member having means to process said spiral stream of air into a cylindrical high pressure envelope of air about said flame.

20. A register to supply combustion air to a flame comprising:

a throw ring;

a frustum including a frusto-conical array of air turning vanes, the major diameter end of said frustum being concentrically secured to said throw ring;

an end plate secured to the opposite minor diameter end of said frustum; a first curved panel secured between said throw ring and said end plate, spaced from and approximating the contour of a first side portion of said frustum and positioned to provide a progressively diminishing space between said first curved panel and said frustum, said panel being defined by its generatrix moving parallel to and progressively closer to said frustum;

a second curved panel secured between said throw ring and said end plate, spaced from and approximating the contour of the side portion of said frustum opposite said first side portion; said second curved panel being positioned to provide a progressively diminishing space between said second convolutely curved panel and said frustum, said second panel being defined by its generatrix moving arcuately and substantially parallel to and progressively closer to said frustum;

the adjacent free edges of said first and second curved panels being spaced apart to provide equal and opposite air entrances; said air turning vanes being contoured to impart a spiral motion to air admitted through said entrances; and blades mounted about the inner periphery of said mounting ring and contoured to form a high pressure envelope of air about said flame.

21. The device of claim 20, wherein said turning vanes are arranged to define a passageway between said end plate and said throw ring adapted to permit fuel to pass therethrough.

22. The device of claim 20, wherein said throw ring blades are arranged to define a passageway through said mounting ring adapted to permit fuel to pass therethrough.

23. The device of claim 20, wherein said throw ring is adapted to be concentrically secured about a fuel throat.

24. The device of claim 20, including means to damper said entrances comprising damper plates mounted on hinge pins extending axially between said mounting ring and said end plate.

25. The device of claim 24, wherein each hinge pin is positioned adjacent an edge of an entrance and pivotally secured to an edge of a damper adjacent said entrance edge.

26. The device of claim 25, including a gusset plate secured to the opposite edge of each entrance to provide a bearing surface for the free end of a respective damper and to enclose said entrance when said free end is in bearing contact therewith.

27. The device of claim 26, wherein each gusset plate comprises a right triangle with its hypotenuse secured to the side of an adjacent curved panel and its base secured to said end plate, whereby its side is normal to said throw ring and said end plate, and the free end of a corresponding damper makes closing contact with said side.

28. A register to supply combustion air to the throat of an open flame heating device comprising:

a plurality of air guiding vanes arrayed in a hollow frustoconical configuration; a substantially frustoconical shroud to enclose said vanes having air entrances on opposite sides of said shroud;

dampers hinged to said shroud adjacent said air entrances;

means to adjust said dampers to control the volume of air passing through said entrances; and the inner surface of said shroud being adapted to compress air flow parallel to and inwardly toward said frustoconical array of air guiding vanes, said air directing vanes being concavely curved to provide gradual air flow change of direction with minimal pressure drop.

29. The device of claim 28, wherein said shroud comprises two equal and opposite frustoconical parts spaced apart to define said air entrances, each part being adapted to acurately guide and compress air through a decreasing passageway substantially concentric with said frustoconical array of air guiding vanes.

30. The device of claim 28, wherein said parts and said dampers are adapted to direct air tangential to said frustoconical array of air directing vanes.

31. The device of claim 28, wherein said parts and said dampers are adapted to direct air through both entrances in the same rotational direction about said frustoconical array of air guiding vanes.

32. The device of claim 31, wherein said parts are reversable whereby the rotational direction of air may be selectively predetermined to be clockwise or counterclockwise.

33. The device of claim 28, wherein said shroud and said air guiding vanes are adapted to direct air between said air entrances and said furnace throat with a gradual change of direction and minimal pressure drop.

34. The device of claim 28, wherein said change of direction is substantially ninety degrees.

35. The device of claim 28, wherein said shroud parts are adapted to arculately direct the incoming air evenly along the longitudinal axes of said air directing vanes.

36. The device of claim 28, wherein said shroud parts and dampers are adapted to balance the volume and pressure of the air admitted through opposite entrances.

37. An air register for mounting over the throat of a heating means comprising:

a register frustoconical housing;

a hollow frustoconical core member nested within and spaced from said frustoconical housing to form a frustoconical air chamber; a discharge member;

means to admit air into said housing from opposite sides to create a fluid couple within said air chamber; and said frustoconical core being louvered to intercept and to gradually redirect the air from said air chamber into the interior of said core member and to impart to said air a rotational spiral with a longitudinal thrust toward said discharge member.

38. The device of claim 37, wherein said louvers are biased to the longitudinal axis of said core.

39. The device of claim 37, wherein said louvers are biased to the longitudinal axis of said core and concavely curved to smoothly redirect said air from said air couple into said rotational spiral with a minimum of pressure drop.

* * * * *